US007353957B2

(12) United States Patent
Winig et al.

(10) Patent No.: US 7,353,957 B2
(45) Date of Patent: Apr. 8, 2008

(54) PEGBOARD WITH THROUGH PEG-HOLE MOUNTING

(75) Inventors: Alan Winig, Wynnewood, PA (US); Richard Winig, Villanova, PA (US); James Eldon, Barto, PA (US)

(73) Assignee: SS3 Storage Systems, L.L.C., Wilmington, DE (US)

( * ) Notice: Subject to any disclaimer, the term of this patent is extended or adjusted under 35 U.S.C. 154(b) by 260 days.

(21) Appl. No.: 11/079,402

(22) Filed: Mar. 14, 2005

(65) Prior Publication Data

US 2005/0242047 A1 Nov. 3, 2005

Related U.S. Application Data

(60) Provisional application No. 60/565,967, filed on Apr. 28, 2004.

(51) Int. Cl.
*A47F 5/08* (2006.01)

(52) U.S. Cl. ..... 211/59.1

(58) Field of Classification Search ..... 211/59.1, 211/54.1, 57.1, 183, 87.01, 86.01; 248/225.21, 248/220.31, 221.11, 221.12, 222.41, 220.41, 248/220.42, 220.43, 222.51, 220.22, 224.8
See application file for complete search history.

(56) References Cited

U.S. PATENT DOCUMENTS

| | | | | |
|---|---|---|---|---|
| 1,958,772 | A | | 5/1934 | Stewart |
| 1,992,857 | A | | 2/1935 | Breedlove |
| 2,121,307 | A | | 6/1938 | Swift |
| 2,154,046 | A | | 4/1939 | Kost |
| 2,618,033 | A | | 11/1952 | Tinnerman et al. |
| 2,708,088 | A | * | 5/1955 | Steinke ..... 248/221.12 |
| 2,785,919 | A | | 3/1957 | Grondzik |
| 2,887,802 | A | | 5/1959 | Burmeister |
| 2,956,687 | A | | 10/1960 | Robichaud |
| 2,988,315 | A | * | 6/1961 | Saxe ..... 248/220.22 |
| 2,995,256 | A | | 8/1961 | Schoenfisch |
| 3,012,475 | A | | 12/1961 | Zalewski |
| 3,012,745 | A | | 12/1961 | Donovan |
| 3,063,569 | A | | 11/1962 | Huber |
| 3,066,367 | A | | 12/1962 | Garman |
| 3,156,282 | A | * | 11/1964 | Bedford, Jr. ..... 411/103 |
| 3,191,777 | A | * | 6/1965 | Willits, Jr. ..... 211/106.01 |
| 3,192,667 | A | * | 7/1965 | Bauer ..... 52/27 |
| 3,198,469 | A | * | 8/1965 | Callanan ..... 248/220.22 |
| 3,365,761 | A | | 1/1968 | Kalvig |
| 3,516,634 | A | * | 6/1970 | Schafernak et al. ... 248/220.22 |

(Continued)

*Primary Examiner*—Jennifer E. Novosad
(74) *Attorney, Agent, or Firm*—Duane Morris LLP

(57) ABSTRACT

A pegboard panel includes a plurality of perforations and a plurality of box-anchor receptacles that project outwardly from a rear surface. Each box-anchor receptacle communicates with one of the plurality of perforations and includes a back wall that is spaced from the rear surface and that defines a through opening arranged in substantially coaxial relation with the perforation. A storage system is also provided that includes the foregoing pegboard panel into which a fastener is positioned within the through opening. A portion of the fastener engages the back wall so as to secure the pegboard panel to a structure, e.g., a wall, thereby forming an interface between the fastener, the back wall, and the structure. A support device engages a portion of one of the plurality of box-anchor receptacles so as to be positioned on the front surface of the pegboard panel so that loads supported by the support device act directly upon the fastener-wall-structure interface.

17 Claims, 9 Drawing Sheets

U.S. PATENT DOCUMENTS 3,565,020 A 2/1971 Schier et al.
3,954,243 A 5/1976 Sharp
3,970,276 A 7/1976 Debaigt
4,103,854 A 8/1978 Pliml et al.
4,307,864 A 12/1981 Benoit
4,325,484 A 4/1982 Berry
4,340,144 A 7/1982 Cousins
4,407,476 A 10/1983 Bohannan
4,439,884 A 4/1984 Giorni
4,450,961 A 5/1984 Bies et al.
4,500,943 A 2/1985 Greene
4,506,416 A * 3/1985 Ohminato et al. ..... 24/67 R
4,506,856 A 3/1985 Rich et al.
4,508,301 A 4/1985 Nicholson et al.
4,516,681 A 5/1985 Jahel
4,597,496 A 7/1986 Kaplan
4,619,428 A 10/1986 Bailey
4,632,256 A 12/1986 Gambello
4,697,774 A * 10/1987 Sarton et al. ..... 248/220.22
4,720,069 A 1/1988 Bessinger
4,771,897 A 9/1988 Ho
4,826,022 A 5/1989 Duarte
4,905,951 A 3/1990 Putness
4,909,464 A * 3/1990 Levine et al. ..... 248/220.22
4,932,538 A * 6/1990 Gambello ..... 211/87.01
4,936,565 A 6/1990 Fredrickson
5,005,710 A 4/1991 Hofer
5,080,238 A * 1/1992 Hochman ..... 211/59.1
5,154,304 A 10/1992 McAuley
5,201,430 A 4/1993 Artzer
5,224,609 A 7/1993 Bauer et al.
5,236,344 A * 8/1993 Baron ..... 248/222.51
5,307,585 A 5/1994 Thompson
5,337,987 A 8/1994 Sawatsky
5,482,168 A 1/1996 Welch et al.
5,503,277 A 4/1996 O'Brien
5,507,460 A 4/1996 Schneider
5,507,545 A 4/1996 Krysiak
5,515,969 A 5/1996 Schonenbach
5,531,416 A 7/1996 Remmers
5,573,111 A 11/1996 Gordon
5,597,280 A 1/1997 Stern
5,651,522 A 7/1997 Davis et al.
5,690,684 A 11/1997 Andrews et al.
5,706,936 A 1/1998 Bernstein
5,711,419 A 1/1998 Beales et al.
5,711,435 A 1/1998 Morison et al.
5,738,228 A 4/1998 Bittinger
5,855,274 A 1/1999 Piao
5,881,982 A 3/1999 Hollingsworth et al.
5,906,346 A * 5/1999 Lin et al. ..... 248/224.8
5,909,936 A 6/1999 Daniels et al.
5,915,307 A 6/1999 Tisbo et al.
5,915,572 A 6/1999 Hancock
5,970,663 A 10/1999 McDonough
6,000,912 A 12/1999 Takada et al.
6,019,331 A 2/2000 Hoogland et al.
6,021,986 A * 2/2000 Murdock ..... 248/289.11
6,029,829 A 2/2000 Ovadia
6,050,426 A 4/2000 Leurdijk
6,070,747 A 6/2000 Shea
6,234,436 B1 5/2001 Kump
6,250,466 B1 6/2001 Ernst
6,257,425 B1 7/2001 Liu
6,273,255 B1 8/2001 Rosler
6,273,277 B1 8/2001 Geldenhuys
6,278,061 B1 8/2001 Daoud
6,299,001 B1 10/2001 Frolov et al.
6,309,085 B1 10/2001 Katz et al.
6,405,984 B1 * 6/2002 Simons et al. ..... 248/220.41
6,443,316 B1 * 9/2002 Mao ..... 211/74
6,450,338 B1 9/2002 Chen
6,481,583 B1 11/2002 Black et al.
6,491,267 B1 12/2002 Feldman
6,511,029 B2 * 1/2003 Sawayanagi ..... 248/224.8
6,581,788 B1 6/2003 Winig
6,695,269 B1 2/2004 Anscher

* cited by examiner

PEGBOARD WITH THROUGH PEG-HOLE MOUNTING

CROSS-REFERENCE TO RELATED APPLICATIONS

This application claims the benefit of U.S. Provisional Patent Application No. 60/565,967, filed Apr. 28, 2004.

FIELD OF THE INVENTION

The present invention generally relates to storage and organizational systems, and more particularly to structures used to mount storage and organizational systems onto vertical surfaces.

BACKGROUND OF THE INVENTION

Storage and organizational systems of the type in which a composition board with a plurality of holes is mounted vertically on a surface are well known in the art. These systems, known as pegboards, are often adapted to receive support devices, e.g., hook and peg members, which extend into the holes so that articles may be supported from the forwardly projecting portions of the support device.

Mounting a pegboard in a home typically requires securing the pegboard on a wall of the house. Typical walls in a home are often constructed of either plaster or gypsum board, and do not have sufficient structural strength alone to support a pegboard or the loads caused by items mounted on the pegboard. Installation thus usually involves locating the wall studs located behind the plaster or gypsum board, and fastening a framework through the plaster or gypsum board to one or more studs. The pegboard is then mounted on the framework by placing fasteners, e.g. screws, through several holes disbursed throughout the pegboard, and then driving each fastener into the frame, or through the frame and into a stud. Frames are often necessary to provide sufficient space between the back surface of the pegboard and the wall of the home so as to accommodate engagement portions of the support devices, e.g., hook and peg members, which extend into the holes so that articles may be supported from forwardly projecting portions of the support device.

This arrangement is not only aesthetically undesirable, but also requires mounting holes be provided solely for securing the pegboard to the vertical surface in the pegboard, which could otherwise receive additional support devices. Also, since loads will often be cantilevered to the front surface of the pegboard, the pegboard will be subject to torques which can deteriorate the strength and the stability of the pegboard as well as its connection to the supporting wall. The fact that a frame is often used is also disadvantageous in that additional time and materials beyond the purchase and installation of the pegboard itself must be expended. This situation is further exacerbated when pegboards of the type taught in U.S. Pat. No. 6,581,788, are employed.

More particularly, in pegboard systems such as are disclosed in U.S. Pat. No. 6,581,788, a perforated panel is provided in the form of a planer sheet of material, preferably formed of a metal or polymer, and having a plurality of regularly shaped perforations, disposed in a regular pattern throughout the panel. The perforations are each preferably formed so as to be defined by a circumferential edge, often forming a rectangular or square opening in the panel. The perforated panel is typically about one quarter to one half of an inch thick, with the perforations being arranged in a regular pattern through panel. Hooks having cantilevered latches are releasably snap-fit into these perforations to provide the same storage function as support devices on traditional pegboard systems.

These newer perforated pegboards need to be formed with a perceptible thickness in order to accommodate the cantilevered latches. This need creates difficulty when conventional mounting holes are provided in the board for mounting to vertical surfaces. Either a counter-sunk hole is required, or longer fasteners are needed to overcome the added thickness of these boards. This need results in the foregoing aesthetic issues and general difficulty in mounting the pegboard.

SUMMARY OF THE INVENTION

The present invention provides a pegboard panel having a front surface, a rear surface, and a plurality of perforations. A plurality of box-anchor receptacles project outwardly from the rear surface. Each box-anchor receptacle communicates with one of the plurality of perforations and includes a back wall that is spaced from the rear surface and that defines a through opening arranged in substantially coaxial relation with the perforation.

A storage system is also provided that includes the foregoing pegboard panel into which a fastener is positioned within the through opening. A portion of the fastener engages the back wall so as to secure the pegboard panel to a structure, e.g., a wall, thereby forming an interface between the fastener, the back wall, and the structure. A support device engages a portion of one of the plurality of box-anchor receptacles so as to be positioned on the front surface of the pegboard panel so that loads supported by the support device act directly upon the fastener-wall-structure interface.

Significantly, not only does this structural arrangement provide an improved aesthetic appearance to the pegboard panel, but it also allows for the positioning of the load-bearing parts, e.g., hooks, pegs, shelves, directly over the fastener holding the pegboard panel. In this way, substantially all of the bending and shear loads that are applied to the pegboard panel as a result of supporting loads on the support devices, act directly upon the fastener-wall-interface, thus preventing unwanted and damaging torque loads from being applied to the pegboard panel. Moreover, the perforations allow a support device to be secured to the pegboard panel so that there is no need for a frame when mounting the pegboard panel to a wall.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
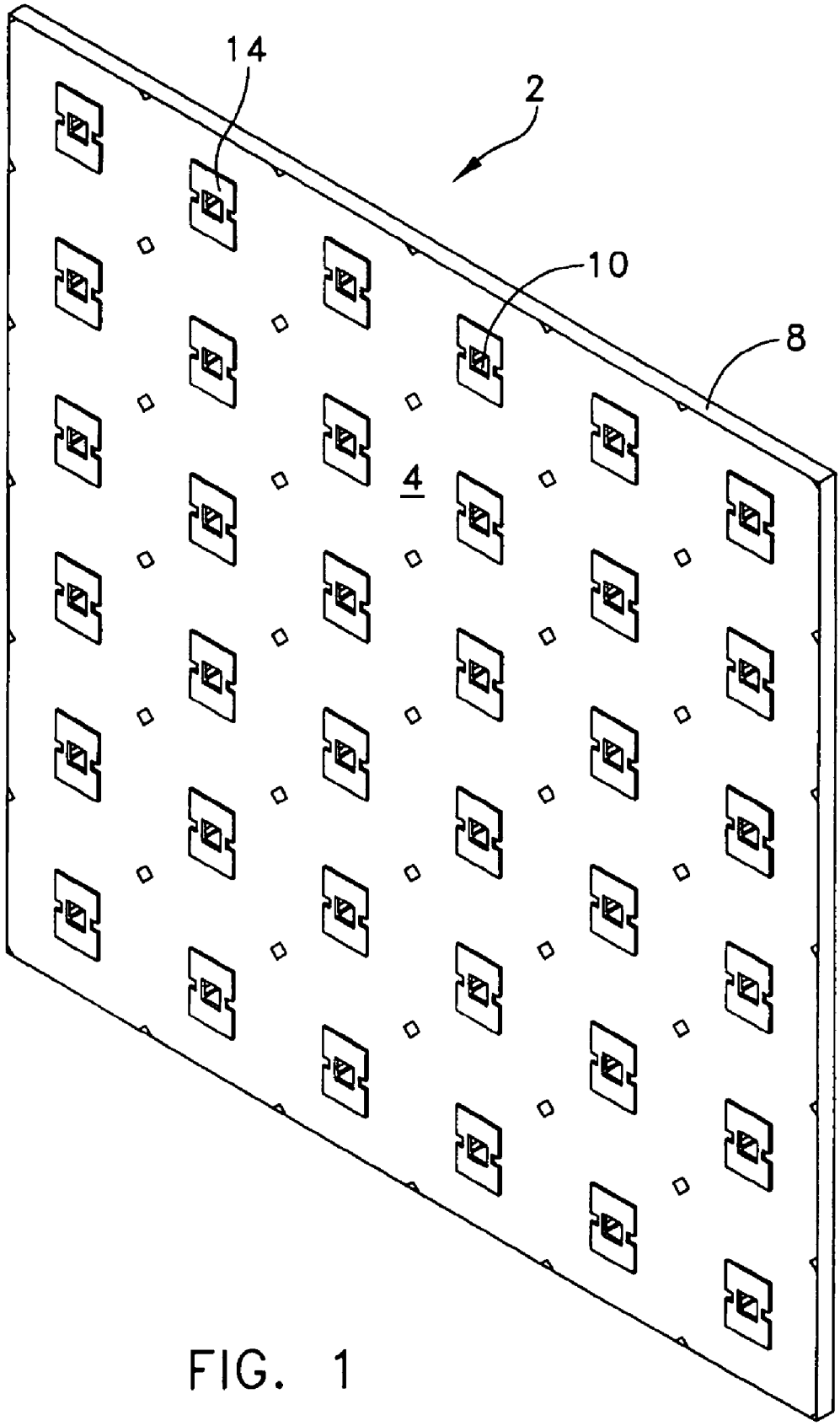
FIG. 1 is a perspective view of a pegboard panel formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
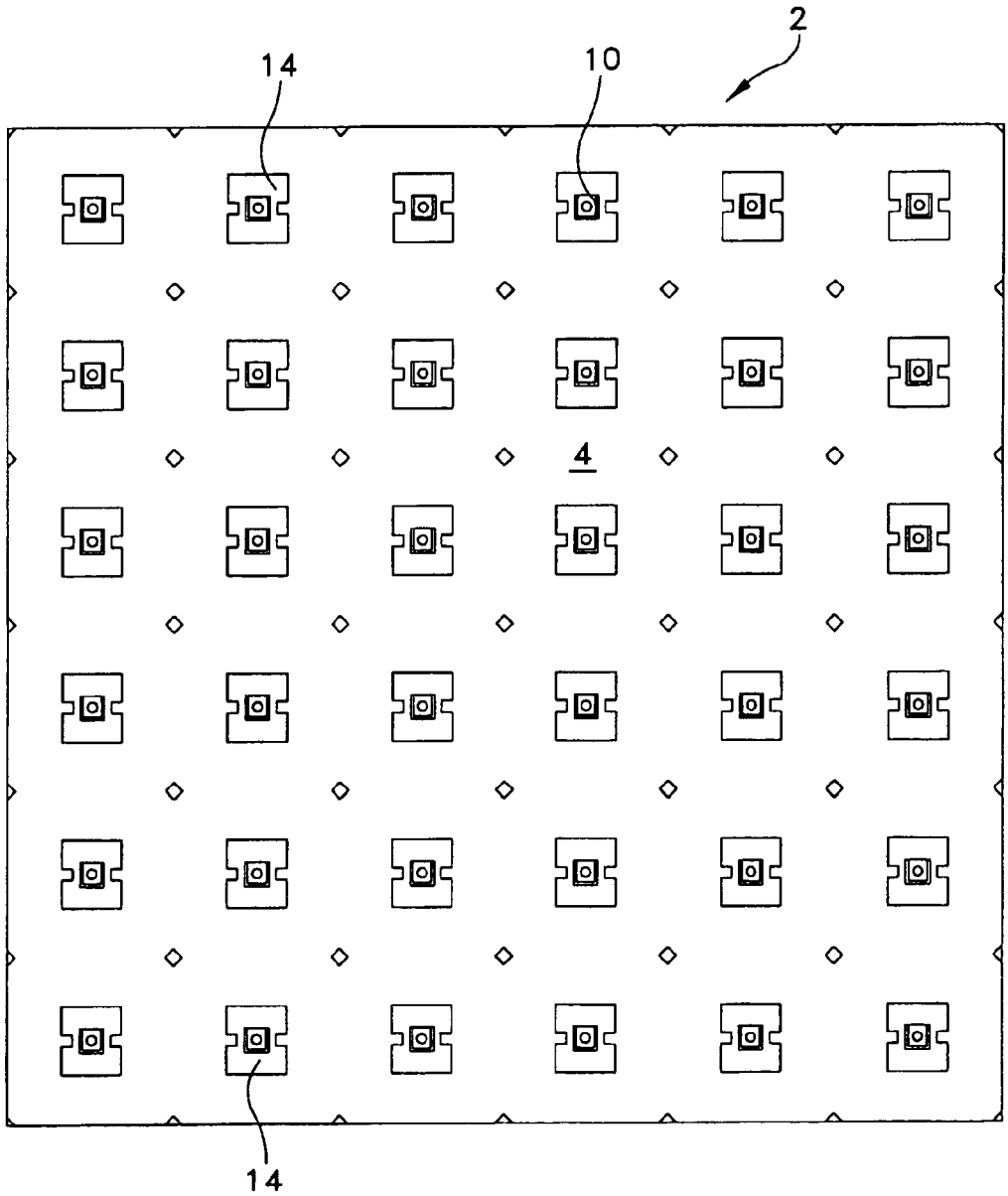
FIG. 2 is a front view of a pegboard panel formed in accordance with the present invention.
Figure 3:
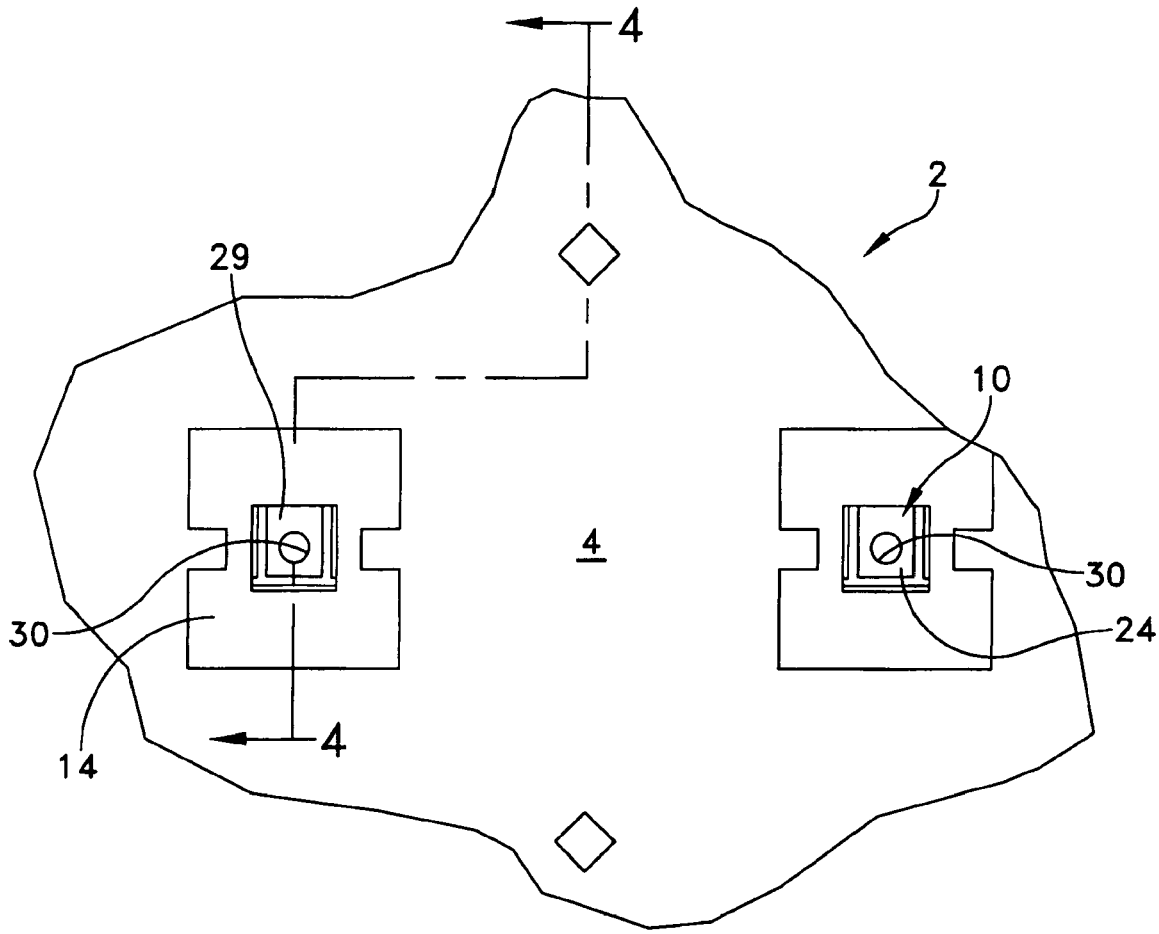
FIG. 3 is a broken-away, front view of a pegboard panel formed in accordance with the present invention.
Figure 4:
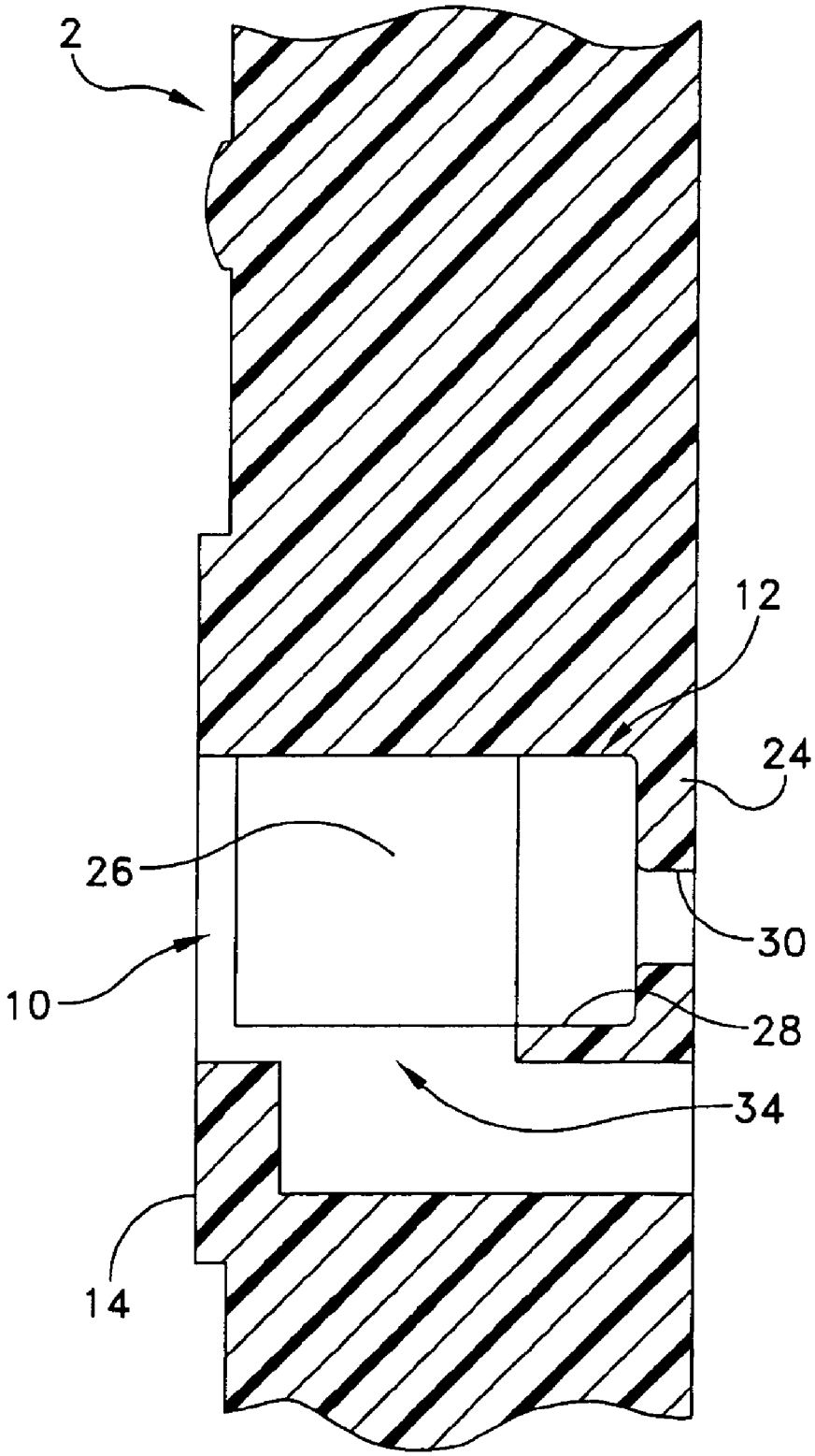
FIG. 4 is a broken-away, cross-sectional view of a novel perforation formed in accordance with the present invention.
Figure 5:
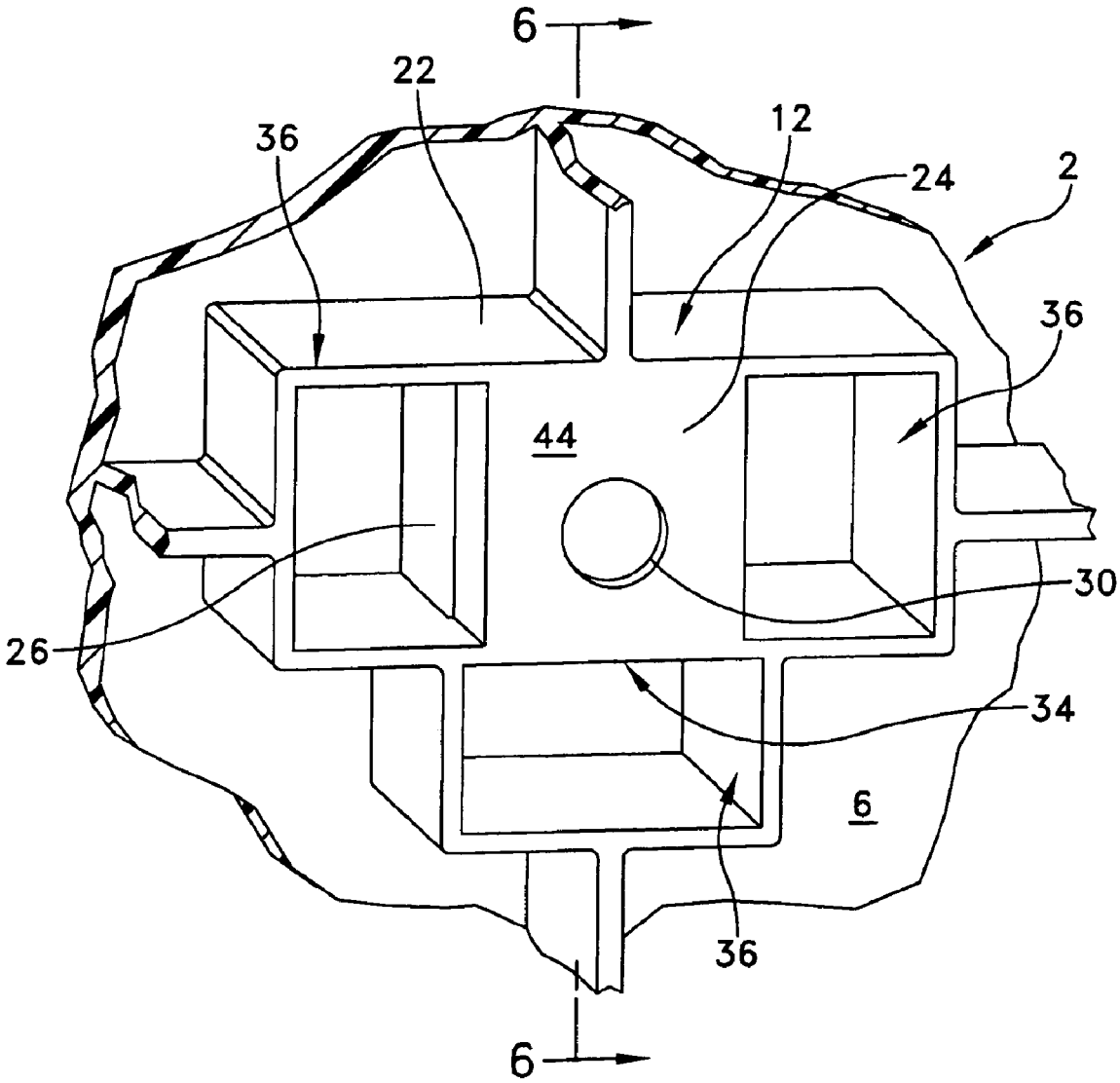
FIG. 5 is a broken-away, rear view of a novel perforation formed in accordance with the present invention.
Figure 6:
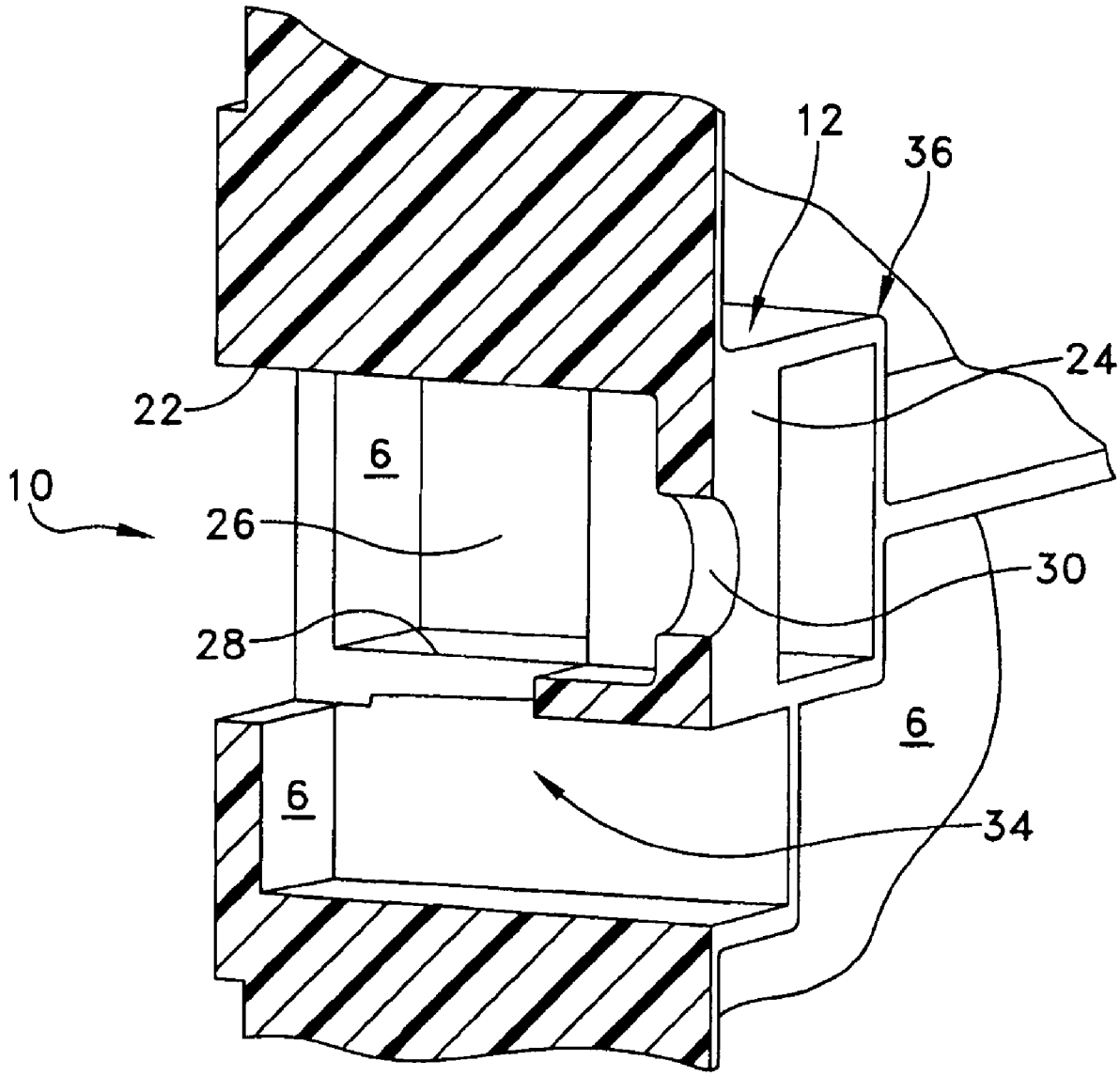
FIG. 6 is a broken-away, cross-sectional view of a novel perforation formed in accordance with the present invention.
Figure 8:
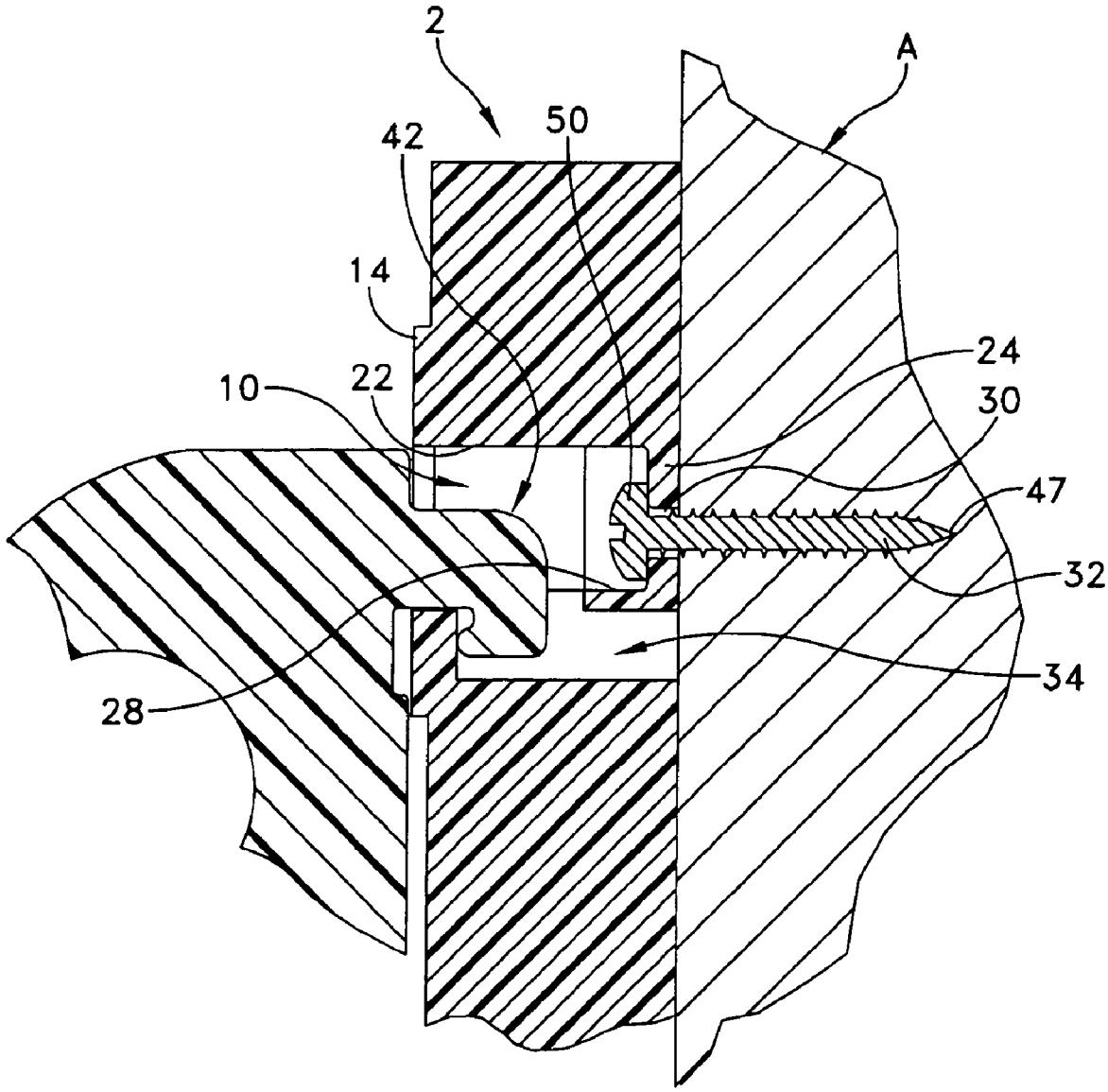
FIGS. 8 and 9 are a broken-away, cross-sectional view, as taken along line 8-8 in FIG. 7, of a storage system formed in accordance with the present invention.
Figure 9:
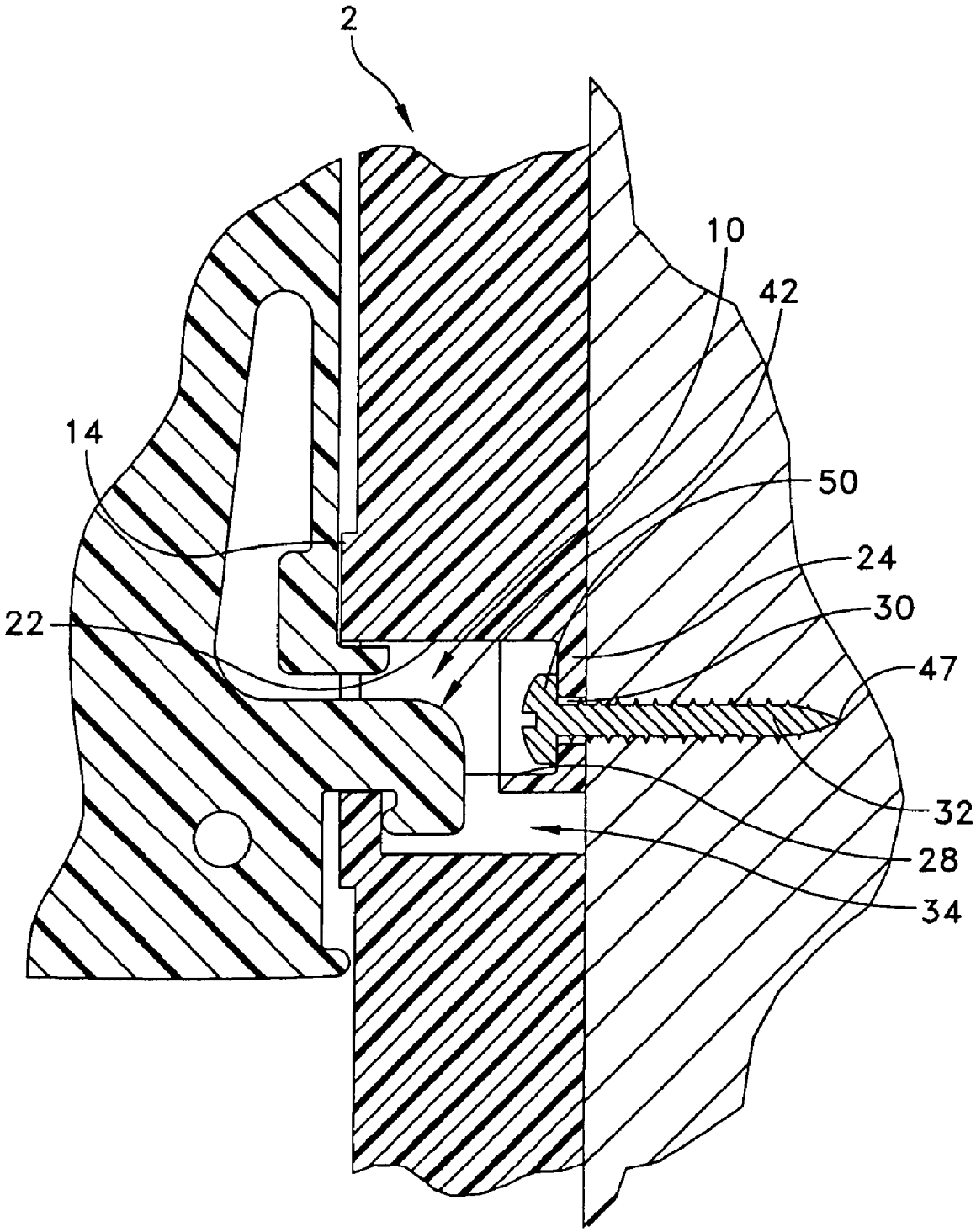

Referring to FIGS. 1, 2, and 5, a pegboard panel 2 formed in accordance with the present invention includes a front surface 4, a rear surface 6, an annular peripheral wall 8, a plurality of openings or perforations 10, and a plurality of box-anchor receptacles 12. Annular peripheral wall 8 projects outwardly from the peripheral edge of rear surface 6 in surrounding relation to plurality of perforations 10 and plurality of box-anchor receptacles 12, and is typically about one quarter to one half of an inch thick. Each perforation 10 extends through pegboard panel 2 from front surface 4 to rear surface 6 in a regular pattern, and communicates with an interior portion of a corresponding box-anchor receptacle 12 (FIGS. 4, 6, and 8). A pad 14 is positioned in surrounding relation to each perforation 10, and stands proud of front surface 4 (FIG. 4). Pegboard 2 may be formed from either metal or polymer, as long as the material comprises sufficient structural integrity to withstand both bending and shear loads without appreciable deformation. Pegboard panel 2 is often provided in modules of about two to three feet wide. Of course, it will be understood that perforated pegboard panel 2 may have various lengths and widths, depending upon the size of the storage system in which it is being installed.

Referring to FIGS. 3-6, each box-anchor receptacle 12 projects outwardly from rear surface 6 of pegboard panel 2 as a part of a regular pattern of box-anchor receptacles that corresponds to the pattern of perforations 10, and comprises a top wall 22, a back wall 24, confronting side walls 26, and a bottom ledge 28. More particularly, top wall 22, back wall 24, and confronting side walls 26 are preferably arranged on rear surface 6 so as to form a hollow receptacle space, often a hollow cube. An opening 30 is defined through the center of back wall 24, and is sized so as to receive a fastener 32, e.g., a wood screw or sheet metal screw, or the like. Bottom ledge 28 is positioned in spaced confronting relation to top wall 22 and in annular relation to a bottom opening 34, such that perforation 10 opens into of box-anchor receptacle 12, with bottom opening 34 forming an exit way leading from the interior of the hollow cube. A plurality of structural reinforcement members 36 are arranged in buttressing relation to the outer portions of top wall 22, back wall 24, and confronting side walls 26 so as to provide structural rigidity and shear strength to box-anchor receptacle 12. Often, structural members 36 are arranged in rectilinear forms, i.e., open squares, rectangles, or other polygonal shapes (FIG. 5) that surround the outer portions of box-anchor receptacle 12 so as to provide reinforcement and buttressing, particularly against shear loads.

Figure 7:
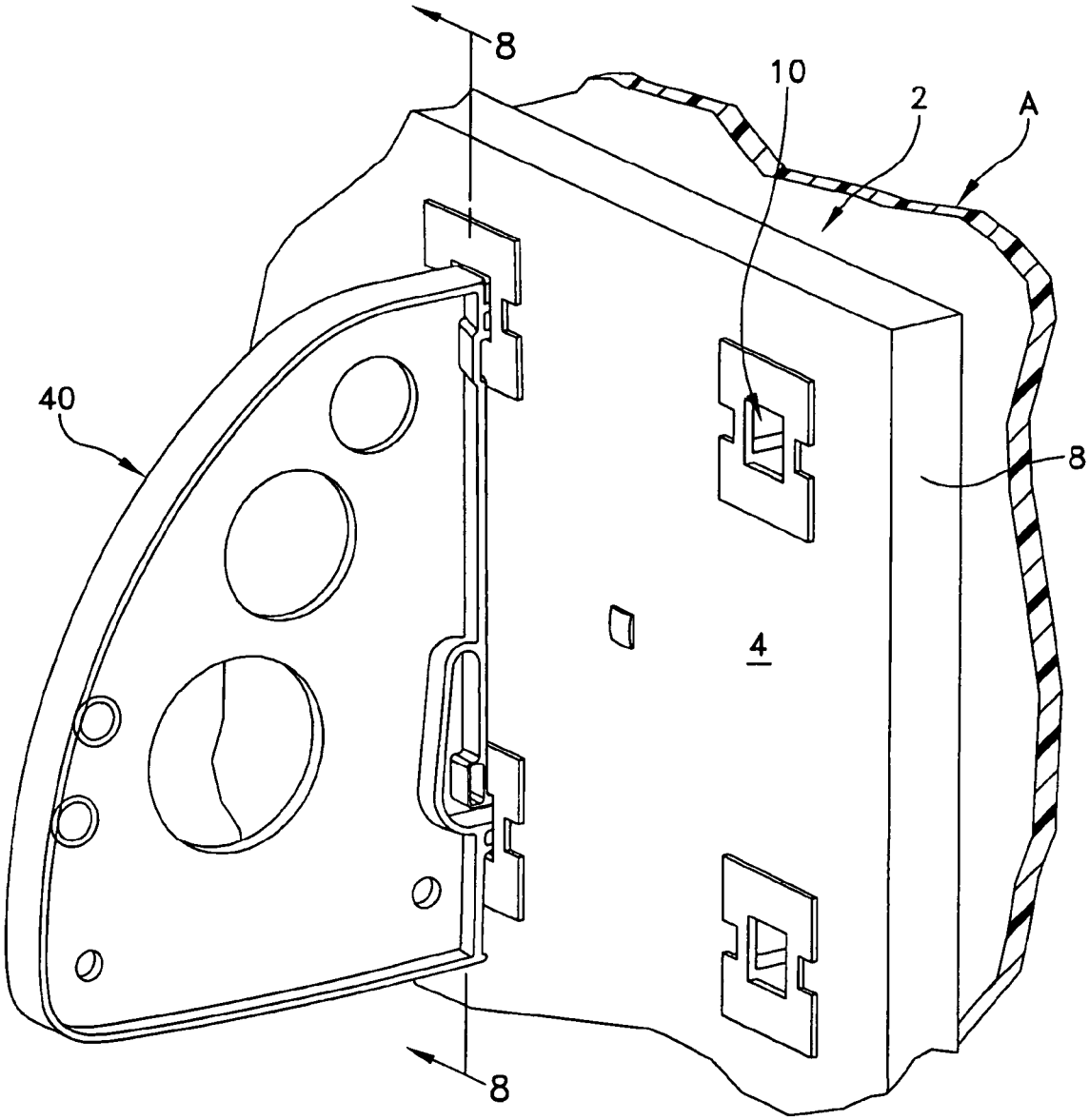
FIG. 7 is a partially broken-away, perspective view of a storage system formed in accordance with the present invention.

Pegboard panel 2 is often arranged on the interior or exterior wall A of a room or shop area so that a plurality of support devices 40 may be positioned on front surface 4 (FIG. 7). For convenience, in this specification, the term "support device" will be used to represent a type of fixture that is attachable to pegboard panel 2, by insertion of a catch element 42 (often "hook" or "L" shaped) into at least one of perforations 10, and used to hold various implements, i.e., hand tools, garden tools, instruments, wires, cables, display objects (such as packages, blister display packs, vacuum display packs, loose hardware or household items, grocery items, department or variety store items, and shelves, pictures, wire frames, and the like).

More particularly, pegboard panel 2 is mounted upon a wall A in the following manner. Pegboard panel 2 is arranged so that rear surface 6 is positioned in confronting parallel relation to a front surface of wall A. Once in this position, pegboard panel 2 is moved towards wall A until annular peripheral wall 8 engages wall A. In this position, pegboard panel 2 sits flush on the outer surface of wall A such that back surface 44 of back wall 24 of plurality of box-anchor receptacles 12 engages at least a portion of wall A. Once in this position, a fastener such as wood screw 32 is arranged in confronting coaxial relation with both a perforation 10 and opening 30 of a selected box-anchor receptacle 12. Once in this position, wood screw 32 is moved toward wall A until its pointed tip 47 travels through opening 30 and engages the surface of wall A. Once wood screw 32 is then rotated so as to be driven into wall A. As the shaft and threads of wood screw 32 moves into wall A, head 50 of wood screw 32 draws toward the inner surface of back wall 24. Head 50 engages back wall 24 and secures it in contacting engagement with the portion of wall A that is adjacent to it.

This procedure can be repeated in as many perforations 10 as is necessary to provide secure fixed engagement of pegboard panel 2 to wall A. It should be noted that as a result of this construction, structural members 36 act in cooperation with the structure of box-anchor 12 to provide frame-like support at each position in which a wood screw 32 has been driven into wall A. Advantageously, head 50 of wood screw 32 is not readily obvious upon viewing front surface 4 of pegboard panel 2. Additionally, if a stud underlying wall A is not engaged by any one or more wood screws 32, it is only necessary to move to adjacent perforations 10 in an attempt to drive a wood screw 32 into a stud.

Significantly, not only does this structural arrangement provide an improved aesthetic appearance to pegboard panel 2, but it also allows for the positioning of the load-bearing parts, e.g., hooks, pegs, shelves, directly over wood screw 32 holding pegboard panel 2. In this way, substantially all of the bending and shear loads, that are applied to pegboard panel 2 as a result of supporting loads on those hooks and shelves, act directly upon the screw-wall-surface interface, i.e., orthogonally with the screw-wall surface interface, thus preventing unwanted and damaging torque loads from being applied to pegboard panel 2.

It is to be understood that the present invention is by no means limited only to the particular constructions herein disclosed and shown in the drawings, but also comprises any modifications or equivalents within the scope of the claims.

What is claimed is:

1. A pegboard panel comprising:

a front surface, a rear surface, and a plurality of perforations; and a plurality of box-anchor receptacles projecting outwardly from said rear surface, each communicating with one of said plurality of perforations and comprising a back wall that is attached to, but spaced from said rear surface and that defines a through opening arranged in substantially coaxial relation with said perforation which receives a fastener for mounting said pegboard panel to a surface;

wherein each of said box-anchor receptacles each comprise a pair of confronting side walls that project outwardly from and are attached to said rear surface so as to support said back wall in spaced relation to said rear surface, a top wall, and an internally disposed bottom ledge so as to form a hollow cube;

wherein each of said perforations extends through said front surface to said rear surface and through said receptacle to said back wall in a regular pattern, and communicates with an interior portion of a corresponding box-anchor receptacle.

2. A pegboard panel according to claim 1 wherein said through opening is defined in a central portion of said back wall, and is sized so as to receive a portion of said fastener.

3. A pegboard panel according to claim 1 wherein said bottom ledge is positioned in spaced confronting relation to said top wall and in annular relation to a bottom opening, such that said one of said plurality of perforations communicates with said bottom opening.

4. A pegboard panel according to claim 1 comprising a plurality of structural reinforcement members located on said rear surface so as to buttress said box-anchor receptacles.

5. A pegboard panel according to claim 4 wherein said confronting side walls engage said structural reinforcement members so as to provide structural rigidity and shear strength to each of said box-anchor receptacles.

6. A pegboard panel according to claim 4 wherein said structural members are arranged in rectilinear forms selected from the group consisting of open squares, rectangles, and polygons that are arranged in buttressing relation to outer portions of each of said box-anchor receptacles so as to provide reinforcement and structural support against shear loads.

7. A pegboard panel according to claim 1 comprising an annular peripheral wall that projects outwardly from a peripheral edge of said rear surface in surrounding relation to said plurality of perforations and said plurality of box-anchor receptacles.

8. A pegboard panel according to claim 1 wherein a pad is positioned in surrounding relation to each of said perforations.

9. A storage system comprising:

a pegboard panel having a front surface, a rear surface, a plurality of perforations, and a plurality of box-anchor receptacles projecting outwardly from said rear surface, each communicating with one of said plurality of perforations and comprising a back wall that is attached to, but spaced from said rear surface and defines a through opening arranged in substantially coaxial relation with said perforation so as to receive a fastener for mounting said pegboard to a surface;

wherein each of said box-anchor receptacles each comprise a pair of confronting side walls that project outwardly from and attached to said rear surface so as to support said back wall in spaced relation to said rear surface, a top wall, and an internally disposed bottom ledge so as to form a hollow cube;

a fastener positioned within said through opening and engaging said back wall so as to secure said pegboard panel to a structure thereby forming an interface between said fastener, said back wall, and said structure; and a support device that engages a portion of one of said plurality of box-anchor receptacles and is positioned on said front surface extending outwardly therefrom in a direction away from said back wall so that loads supported by said support device act directly upon said fastener-wall-structure interface.

10. A storage system according to claim 9 wherein said through opening is defined through a central portion of said back wall, and is sized so as to receive a portion of a fastener and engage a portion of said fastener.

11. A storage system according to claim 9 wherein said bottom ledge is positioned in spaced confronting relation to said top wall and in annular relation to a bottom opening, such that said one of said plurality of perforations communicates with said bottom opening.

12. A storage system according to claim 9 comprising a plurality of structural reinforcement members that are arranged in buttressing relation to outer portions of each of said box-anchor receptacles.

13. A storage system according to claim 12 wherein said confronting side walls engage and are buttressed by said structural reinforcement members so as to provide structural rigidity and shear strength to each of said box-anchor receptacles.

14. A storage system according to claim 12 wherein said structural members are arranged in rectilinear forms selected from the group consisting of open squares, rectangles, and polygons that are arranged in surrounding relation to outer portions of said box-anchor receptacle so as to provide reinforcement and buttressing against shear loads.

15. A storage system according to claim 9 comprising an annular peripheral wall that projects outwardly from a peripheral edge of said rear surface in surrounding relation to said plurality of perforations and said plurality of box-anchor receptacles.

16. A storage system according to claim 9 wherein each of said perforations extends through said pegboard panel from said front surface to said rear surface to said back wall in a regular pattern, and communicates with an interior portion of a corresponding box-anchor receptacle.

17. A storage system according to claim 9 wherein a pad is positioned in surrounding relation to each of said perforations.

* * * * *